United States Patent [19]

Graham et al.

[11] 4,386,866

[45] Jun. 7, 1983

[54] FOUNTAIN PEN CARTRIDGE

[75] Inventors: George W. Graham, North Kingstown; William E. Tucker, Harmony, both of R.I.

[73] Assignee: A. T. Cross Company, Lincoln, R.I.

[21] Appl. No.: 277,862

[22] Filed: Jun. 26, 1981

Related U.S. Application Data

[63] Continuation-in-part of Ser. No. 142,701, Apr. 22, 1980, abandoned.

[51] Int. Cl.[3] ..... B43K 5/04; B43K 5/14

[52] U.S. Cl. ..... 401/133; 401/134; 401/241

[58] Field of Search ..... 401/132, 133, 134, 135, 401/241

[56] References Cited

U.S. PATENT DOCUMENTS

| | | | |
|---|---|---|---|
| 3,521,969 | 7/1970 | Mutschler | 401/225 |
| 3,532,436 | 10/1970 | Konig | 401/227 |

FOREIGN PATENT DOCUMENTS

| | | | |
|---|---|---|---|
| 1151751 | 7/1963 | Fed. Rep. of Germany | 401/134 |
| 2003229 | 7/1971 | Fed. Rep. of Germany | 401/133 |
| 86673 | 12/1966 | France | 401/133 |
| 1507251 | 12/1967 | France | 401/133 |
| 1571383 | 6/1969 | France | 401/133 |
| 690541 | 4/1962 | Italy | 401/133 |
| 691547 | 7/1965 | Italy | 401/133 |
| 878117 | 9/1961 | United Kingdom | 401/134 |

*Primary Examiner*—Steven A. Bratlie

*Attorney, Agent, or Firm*—Barlow & Barlow, Ltd.

[57] ABSTRACT

The present invention relates to an improvement in a fountain pen in which the fountain pen is provided with a writing point feed bar and a casing for supporting the writing mechanism, there being a partition located adjacent to the feed bar and having a cylindrical boss extending away therefrom. The cartridge is provided with a double lip interior open end which is adapted to fit over the boss and conduct the ink into the bore that extends through the boss that communicates with the feed bar. The tapered nose end of the cartridge snugly fits into the bore of the casing adjacent the boss that communicates with the feed bar. This not only insures that the lip sealing is forced radially inward and is not disturbed, by also insures that the end of the cartridge engages the partition wall for sealing and the interior wall of the casing for additional sealing.

3 Claims, 3 Drawing Figures

FOUNTAIN PEN CARTRIDGE

CROSS-REFERENCE TO RELATED APPLICATIONS

This application is a continuation-in-part of our application Ser. No. 142,701 filed Apr. 22, 1980, now abandoned.

BACKGROUND OF THE INVENTION

Cartridges for feeding ink in fountain pens have been known in the art particularly as represented by U.S. Pat. No. 3,532,436 (Koenig) and U.S. Pat. No. 3,521,969 (Mutschler). These cartridges have generally taken the form of a nipple-like end which is adapted to extend over a pin or stud and extends into a casing on the side remote from a feed bar. The fitting of the cartridge, made of plastics material, over a protruding part is solely limited by the friction of the cartridge engaging type stud, for example. As is well known, all deformable materials tend to lose their resiliency and in time with structures of this nature leakage can occur.

SUMMARY OF THE PRESENT INVENTION

The present invention relates to an improved fountain pen which has the usual writing point and feed bar contained in the forward end of a casing which is divided adjacent the inner end of the feed bar by a bore containing capillary feed channels and a passageway for air. The partition is particularly defined by a boss which extends into the casing on the side of the partition opposite the feed bar. A cartridge to contain ink has a closed upper end and a nose portion with an open lower end, the open end engaging the outer diameter of the boss. The inner wall of the lower end is particularly defined by a sealing means defined by a double lip protrusion which snugly fits in sealing engagement with the outer diameter of the boss. The sealing means has an inner diameter smaller than the outer diameter of the boss and the tapered nose engaging the inner wall of the casing not only forces the sealing means inwardly, but also itself provides a seal. Further, the open end of the nose engages the partition and achieves a still further seal.

The arrangement of the double lip sealing of the cartridge about the boss achieves a number of beneficial results. Firstly, the inner pressure within the casing of the cartridge will act on the inner portion of the lip forcing it under pressures which may exceed normal atmospheric pressure to press it against the boss. Additionally, any atmospheric pressures act on the other portion of the lip in a similar fashion, compensating for any pressure differentials, and with this structure the seal between the cartridge and the boss may be readily perfected. To maintain the seal, the cartridge has a stepped, tapered nose portion which seats in the casing. The cartridge is stabilized by a casing part with a stepped interior and when the tapered stepped nose portion is seated, there will be at least two spaced contacts. This construction not only axially stabilizes the cartridge and prevents any air from entering through the seal which would upset the fine balance in the ink feed system of the fountain pen, the seal being forced radially inward. Also the nose seats against the partition and the side walls seat against the inner wall of the casing, providing additional sealing as noted above.

DESCRIPTION OF THE PREFERRED EMBODIMENT

Figures 1, 2, 3:
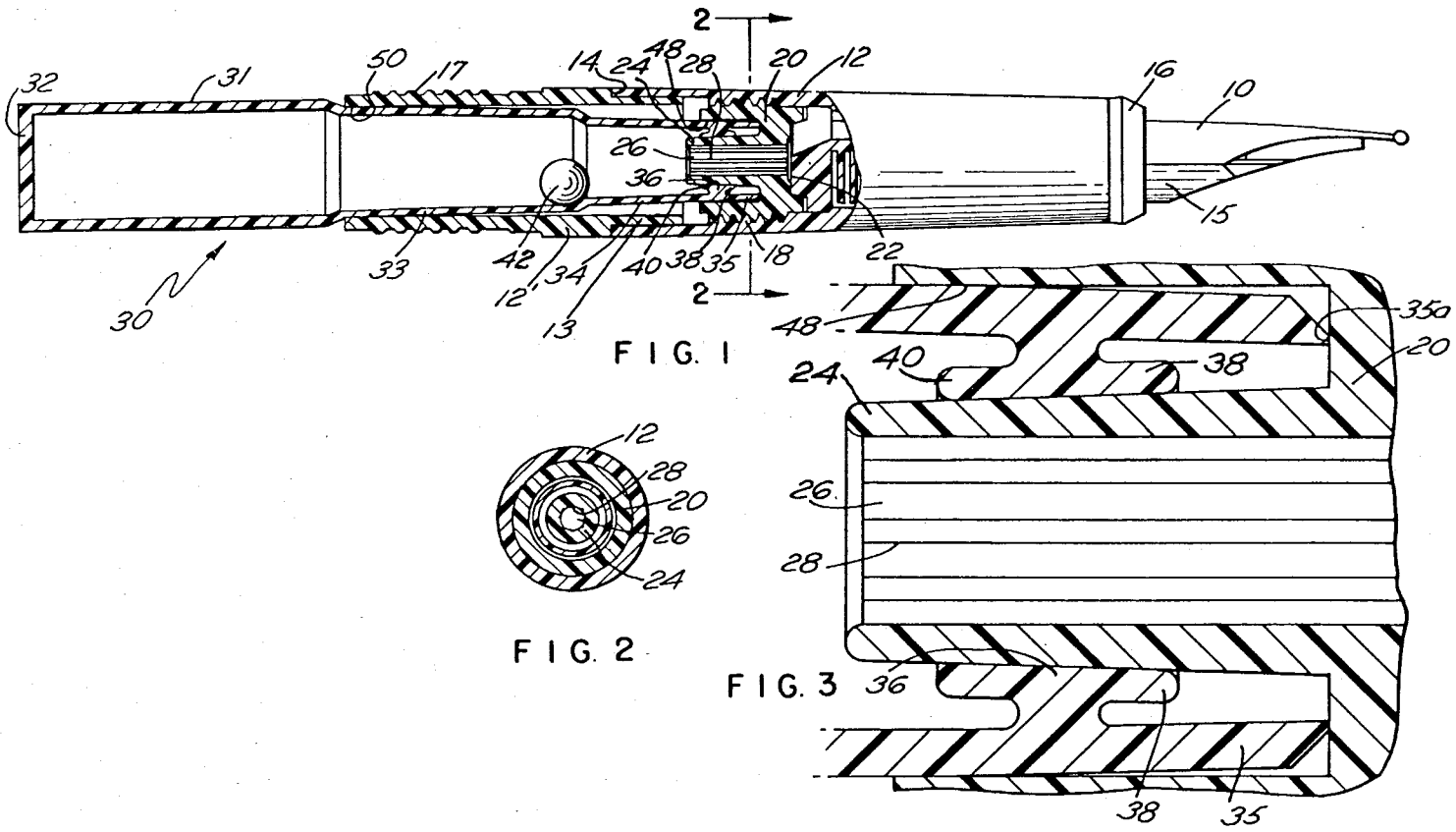
FIG. 1 is a longitudinal elevation of a fountain pen, with parts broken away and shown in section.
FIG. 2 is a section on line 2—2 of FIG. 1.
FIG. 3 is an enlarged partial sectional view of the sealing of the cartridge to the pen.

Referring now to the drawings, the fountain pen illustrated in FIG. 1 has the usual nib 10 which extends from a casing 12 and which is assembled on a feed bar 15, all of which is held in the casing by a securing nut 16. The end of the casing 12 remote from the nib has an interior threaded section 18. A partition 20 in the casing 12 has an outer threaded portion which engages casing threads 18 and a front end 22 which abuts the feed bar 15. The opposite end of the partition has firstly an elongated boss 24 with a bore 26 having one or more capillary channels 28 located therein and secondly an inner wall of the threaded portion which is coaxial with the boss 24.

A rear casing part 12' acts as a continuation of the main casing 12 and has a reduced end 13 which defines a shoulder 14 fitting snugly into and abutting the rear end of the casing 12. Screw threads 17 on the exterior of the casing part 12' receive the threaded portion of an end cap (not shown) while the interior bore receives the cartridge 30. The interior bore of the casing which receives the cartridge effectively has two diameters, namely a larger diameter at the part 12' and a smaller diameter by the inner wall of the partition member 20. In effect, the bore may be defined as a stepped bore to receive the cartridge 30.

A cartridge or ink reservoir 30 comprises essentially a hollow cylindrical body which may be formed of a suitable semi-rigid material such as plastic material, for example, polyethylene. The cartridge 30 has an outer cylindrical part 31 with a rear end wall 32, an intermediate tapered part 33 and a tapered nose part 34. The latter has a front end 35 from the inner portion of which there extends a double lip seal 36 which defeines a pair of lips 38 and 40. Also shown within the cartridge, is a ball 42 which initially seals the cartridge by extending across the double lip bore, it being opened by displacement when the lower end of the cartridge is inserted over the boss 24. The double lip formation 36 defines a forward lip 38 and a rearward lip 40. The rearward lip 40 is acted upon by the pressure of the ink within the cartridge 30 so that if the pressure within the cartridge increases, the lip 40 will be forced against the bore 24 with a greater force, thus preventing ink within the cartridge 30 from being forced out of it. Similarly should for some reason there be an excessive pressure on the outer portion exposed to the atmosphere at the location of the lip 38 a similar action will occur, thus ensuring that at all times regardless of the ambient pressures in existence, the cartridge will tightly seal about the boss 24. To further ensure sealing the tip 35*a* of the nose front end engages the partition 20.

The cartridge is shown as fully seated in the drawing and in this position the forward nose part engages the inner wall of the partition member at 48 to provide a seal and force the seals 36 inwardly. Additionally, the intermediate portion 33 engages the outer end of the casing as at 50. As will be apparent, points 48 and 50 are spaced apart and support the cartridge in its seated position. The support stabilizes the cartridge and prevents upset of the lip seal. The tapered sections also permit ease of insertion of the cartridge into the casing.

The cartridge is seated in the fountain pen in a manner to insure that no leakage occurs in airplanes (with reduced atmospheric pressure) as well as at sea level, by the simple expedient of having the portion designated at 48 serving as a seal and a pressure point for lip seals 38 and 40 along with a seal as at 35*a*, thus providing four sealing points.

We claim:

1. In a fountain pen having a writing point, a feed bar and a casing for supporting the point and feed bar, a partition in the casing adjacent the feed bar having a cylindrical boss extending away from the feed bar with a bore therethrough, said bore having capillary slots in the wall thereof, a cartridge having a closed end and an open end and an exterior tapered nose, the open end having a sealing means located on the inner wall and spaced longitudinally inward of the open end, inner wall casing means engaging the tapered nose, said sealing means defining a protrusion with diverging lips, the inner diameter of the sealing means being smaller than the outer diameter of the boss, the engagement of said tapered nose with the inner wall forcing the sealing means inwardly whereby a tight joint is achieved by the sealing means engaging said cylindrical boss, a second seal being provided between the nose engagement point and the inner wall casing means, said open end engaging said partition to provide an additional seal.

2. In a fountain pen as in claim 1 wherein the nose of the cartridge is provided with a stepped tapered nose portion and the casing has a stepped inner wall to receive the cartridge.

3. In a fountain pen as in claim 1 or claim 2 wherein the partition comprises a re-entrant bore that defines a cylindrical inner wall within the casing extending about the cylindrical boss.

* * * * *